US010526942B2

(12) United States Patent
Higashiyama

(10) Patent No.: US 10,526,942 B2
(45) Date of Patent: Jan. 7, 2020

(54) INTERNAL COMBUSTION ENGINE AND EXHAUST-GAS-COMPONENT ESTIMATING METHOD

(71) Applicant: ISUZU MOTORS LIMITED, Tokyo (JP)

(72) Inventor: Shigeru Higashiyama, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 237 days.

(21) Appl. No.: 15/549,141

(22) PCT Filed: Feb. 1, 2016

(86) PCT No.: PCT/JP2016/052898
§ 371 (c)(1),
(2) Date: Aug. 4, 2017

(87) PCT Pub. No.: WO2016/125735
PCT Pub. Date: Aug. 11, 2016

(65) Prior Publication Data

US 2018/0023430 A1 Jan. 25, 2018

(30) Foreign Application Priority Data

Feb. 6, 2015 (JP) ..... 2015-022015

(51) Int. Cl.
*F01N 3/021* (2006.01)
*F01N 11/00* (2006.01)

(52) U.S. Cl.
CPC ..... *F01N 3/021* (2013.01); *F01N 11/00* (2013.01); *F01N 2550/04* (2013.01); *F01N 2900/14* (2013.01); *F01N 2900/16* (2013.01)

(58) Field of Classification Search
CPC ..... F01N 3/021; F01N 11/00; F01N 2900/16; F01N 2900/14; F01N 2550/04
See application file for complete search history.

(56) References Cited

U.S. PATENT DOCUMENTS 5,889,196 A * 3/1999 Ueno ..... G01N 27/407 204/429
2004/0226284 A1 11/2004 Kitahara et al.
(Continued)

FOREIGN PATENT DOCUMENTS

CN 1550646 A 12/2004
CN 101018937 A 8/2007
(Continued)

OTHER PUBLICATIONS

WO-2014083626, Machine Translation, Translated on May 23, 2019.*
(Continued)

*Primary Examiner* — Patrick D Maines
(74) *Attorney, Agent, or Firm* — Procopio, Cory, Hargreaves & Savitch LLP

(57) ABSTRACT

An internal combustion engine, which includes a collection device that is arranged in an exhaust pipe through which an exhaust gas emitted from a cylinder passes and collects PM contained in the exhaust gas and an NOx sensor that is arranged on an upstream side of the collection device and detects an NOx content in the exhaust gas, includes: an estimating device which estimates a PM content in the exhaust gas at the upstream side of the collection device from a detection value of the NOx sensor, based on a trade-off relation between an NOx emission amount and a PM emission amount from the cylinder.

5 Claims, 4 Drawing Sheets

(56) References Cited

U.S. PATENT DOCUMENTS

| | | | | |
|---|---|---|---|---|
| 2007/0255484 | A1* | 11/2007 | Imai | F02D 41/0007 701/102 |
| 2010/0242442 | A1 | 9/2010 | Kondo et al. | |
| 2012/0318053 | A1* | 12/2012 | Ikemoto | F02D 41/221 73/114.45 |
| 2013/0014641 | A1 | 1/2013 | Takaoka et al. | |
| 2014/0109868 | A1 | 4/2014 | Zhu et al. | |
| 2014/0123608 | A1 | 5/2014 | Sun et al. | |
| 2016/0274075 | A1* | 9/2016 | Ge | G01N 33/0006 |

FOREIGN PATENT DOCUMENTS

| | | | |
|---|---|---|---|
| JP | 2010-249128 | A | 11/2010 |
| JP | 2014-185542 | A | 10/2014 |
| WO | 2011118035 | A1 | 9/2011 |
| WO | 2014083626 | A1 | 6/2014 |
| WO | WO-2014083626 | A1 * | 6/2014 |

OTHER PUBLICATIONS

Extended European Search Report for EP App No. 16746566.5 dated May 29, 2018, 8 pgs.
Office Action dated Jan. 7, 2019 for related CN Patent Application No. 201680008759.1 in 13 pages.
International Search Report and Written Opinion for PCT App No. PCT/JP2016/052898 dated May 10, 2016, 7 pgs.

* cited by examiner

INTERNAL COMBUSTION ENGINE AND EXHAUST-GAS-COMPONENT ESTIMATING METHOD

CROSS-REFERENCE TO RELATED APPLICATIONS

This application is a U.S. National Stage entry of PCT Application No. PCT/JP2016/052898, filed on Feb. 1, 2016, which claims priority to Japanese Patent Application No. 2015-022015, filed Feb. 6, 2015, the contents of which are incorporated herein by reference.

TECHNICAL FIELD

The present invention relates to an internal combustion engine and an exhaust-gas-component estimating method, and particularly to an internal combustion engine in which PM (particulate matter) content in the exhaust gas at an upstream side of a collection device arranged in an exhaust pipe is estimated accurately with a simple configuration, and an exhaust-gas-component estimating method.

BACKGROUND ART

In a diesel engine, PM (particulate matter) contained in an exhaust as is collected by a collection device arranged in an exhaust pipe through which the exhaust gas passes. In case where the collection device is broken or damaged so that a function is lost, the PM is released to an atmosphere.

In this regard, in an engine, a PM sensor is arranged in the exhaust pipe on the downstream side of the collection device, and an abnormality of the collection device is diagnosed in a manner such that the PM sensor detects the PM flowing out to the downstream side of the collection device. The PM sensor is a sensor which outputs a detection value corresponding to a deposition amount of the PM deposited in the element, and applies a high-voltage current to the element so as to combustion-remove the PM deposited in the element in a case here the deposition amount of the PM exceeds a predetermined value.

Incidentally, in the engine including the collection device, in a case where the deposition amount of the PM collected in the collection device is equal to or more than the predetermined value, a regeneration control is performed which combustion-removes the PM deposited in the collection device by raising a temperature of the exhaust gas passing through the collection device. There is a case where the collection device reaches an excessively high temperature by the regeneration control so as to be partially eroded, whereby a breakage occurs in the collection device, for example, a hole is bored.

Then, in the engine the breakage of the collection device is diagnosed based on a variation of the detection value of the PM sensor arranged at the downstream of the collection device, that is, a variation of a PM content in the exhaust gas having passed through the collection device. However, for example, even in a case where the deposition amount of the PM deposited in the collection device is not close to the predetermined value or the collection device is not broken, when the inflow amount of the PM flowing in the collection device increases, the detection value of the PM sensor arranged on the downstream side is changed by change of an inflow amount of the PM flowing in the collection device, for example, the detection value of the PM sensor arranged on the downstream side also increases. For this reason, a problem occurs in which the breakage of the collection device cannot be diagnosed accurately only by the variation of the detection value of the PM sensor arranged on the downstream side.

With respect thereto, for example, as described in Japanese Unexamined Patent Application Publication No. 2014-185542 (Patent Literature 1), a device is proposed which diagnoses the breakage of the collection device in a manner such that the inflow amount of the PM flowing in the collection device until the PM deposited in the element of the PM sensor arranged on the downstream side is combustion-removed is detected using the detection value of the PM sensor newly arranged in the exhaust pipe on the upstream side of the collection device or a relation obtained in advance by a simulation between an operating condition of the engine and a emission amount of the emitted PM.

In a case where the inflow amount of the PM flowing in the collection device until a predetermined amount of PM is deposited in the PM sensor arranged on the downstream side is small, the device determines that the PM is released from the broken place of the collection device to the downstream side.

However, the PM sensor arranged on the upstream side of the collection device is exposed to the exhaust gas before the PM is collected, so that a lot of PM is deposited in a short time compared to the PM sensor arranged on the downstream side. Thus, the deposited PM is often combustion-removed necessarily, and failure frequency also becomes high since the frequency of combustion-removal is high as well as the inflow amount of the PM cannot be detected accurately.

In the relation between the operating condition of the engine and the emission amount of the PM according to the simulation, enormous data from various factors such as a fuel injection amount, an intake pressure, an intake amount, and a temperature is necessary to improve accuracy. Further, in a case where an integrated value of the inflow amount of the PM flowing in the collection device is calculated, it is necessary to timely calculate the emission amount of the PM which is changed according to the change of the operating condition of the engine, whereby diagnosis becomes complicated.

CITATION LIST

Patent Literature

Patent Literature 1: Japanese Unexamined Patent Application Publication No. 2014-185542

SUMMARY OF THE INVENTION

Technical Problem

The present invention has been made in consideration of the above situation, and an object thereof is to provide an internal combustion engine in which a PM content in the exhaust gas at an upstream side of the collection device arranged in the exhaust pipe can be estimated accurately with a simple configuration, and an exhaust-gas-component estimating method.

Solution to Problem

An internal combustion engine of the present invention for solving the above-described problem, which includes a collection device that is arranged in an exhaust pipe through which an exhaust gas emitted from a cylinder passes and collects PM contained in the exhaust gas and an NOx sensor that is arranged on an upstream side of the collection device and detects an NOx content in the exhaust gas, includes: an estimating device which estimates a PM content in the exhaust gas at the upstream side of the collection device from a detection value of the NOx sensor, based on a trade-off relation between an NOx emission amount and a PM emission amount from the cylinder.

An exhaust-gas-component estimating method of the present invention for solving the above-described problem, which estimates a PM content in an exhaust gas at an upstream side of a collection device which is arranged in an exhaust pipe, through which the exhaust gas emitted from a cylinder of an internal combustion engine passes, and collects the PM contained in the exhaust gas, the method includes: detecting an NOx content in the exhaust gas at the upstream side of the collection device using an NOx sensor arranged on the upstream side of the collection device; and estimating the PM content in the exhaust gas at the upstream side of the collection device from the detected NOx content, based on an NOx emission amount from the cylinder and a trade-off relation with a PM emission amount.

The trade-off relation between the NOx emission amount and the PM emission amount indicates a relation such that when the NOx emission amount increases, the PM emission amount decreases, and on the other hand, when the NOx emission amount decreases, the PM emission amount increases, and the relation between the NOx emission amount and the PM emission amount is obtained in a shape of map data and the like in advance by the experiments or the tests, and is stored in the storage medium of the estimating device.

Incidentally, the PM content, the PM emission amount, the NOx content, and the NOx emission amount which are described here indicate amounts per unit time, variations during the period set in advance, or the like. In a case where the exhaust gas amount can be calculated, the exhaust gas amount may be replaced with the concentration in the exhaust gas.

Advantageous Effects of the Invention

According to the internal combustion engine of the present invention and the exhaust-gas-component estimating method, with a simple configuration which uses the NOx sensor, which is mounted in the internal combustion engine of the conventional configuration and detects the NOx (nitrogen oxide) content in the exhaust gas, and the trade-off relation between the NOx emission amount and the PM emission amount, the PM content in the exhaust gas at the upstream side of the collection device can be estimated with a high degree of accuracy.

By using the NOx sensor arranged on the upstream side of the collection device, it can be avoided that the cost is increased by adding a new PM sensor on the upstream side of the collection device. Additionally, although the NOx sensor is exposed to the exhaust gas which includes a lot of PM before passing through the collection device, it is prevented that the accuracy of detecting the NOx content is reduced due to deposition of the PM. In addition, there is a less possibility that the fault occurs due to the deposition of the PM. For this reason, it is possible to stably estimate the PM content in the exhaust gas at the upstream side of the collection device with a high degree of accuracy.

By using the PM content, which is estimated accurately, in the exhaust gas at the upstream side of the collection device, the breakage of the collection device can be accurately diagnosed based on the change of the PM content before and after the collection device, and the regeneration control of the collection device can be performed at a proper timing.

DESCRIPTION OF EMBODIMENTS

Hereinafter, the description will be given, about an internal combustion engine of the present invention and an exhaust-gas-component estimating method. Incidentally, in following embodiments, the component amounts in the exhaust gas are described as content amounts or emission amount. However, the component amount can be calculated based on exhaust gas amounts and concentration, and the exhaust gas amounts can be also calculated, whereby the content amount or the emission amount may be replaced with the concentration.

Figure 1:
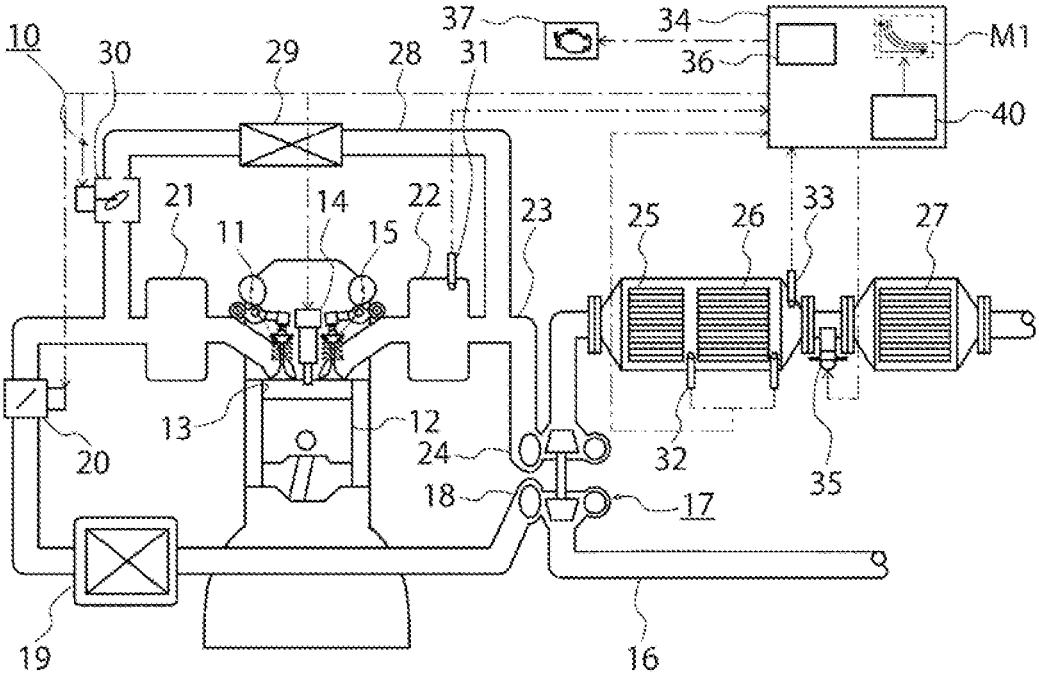
FIG. 1 is an explanation view exemplarily illustrating a first embodiment of an internal combustion engine of the present invention.

FIG. 1 exemplarily illustrates a configuration of a first embodiment of an engine 10 of the present invention. When a diagnose of abnormality of a collection device 26 arranged in an exhaust pipe 23 is performed, or when a regeneration control of the collection device 26 is performed, the engine 10 estimates the PM content in the exhaust as at the upstream side of the collection device 26.

In the engine 10, intake air taken in a cylinder 13 which a piston 12 reciprocates, from an intake valve 11 during operation and fuel injected from a fuel injection valve 14 to a cylinder 13 are combusted in a mixed state, so as to be exhaust gas, and are exhausted from an exhaust valve 15.

The intake air is taken into an intake pipe 16 from outside and compressed by a compressor 18 of a turbocharger 17 to reach a high temperature, and cooled by an intercooler 19. Thereafter, after a flow rate is adjusted by an intake throttle 20, the intake air is taken from the intake valve 11 into the cylinder 13 through an intake manifold 21.

The exhaust gas passes through the exhaust valve 15 from the cylinder 13, and is exhausted from an exhaust manifold 22 to the exhaust pipe 23, so as to operate a turbine 24 of the turbocharger 17. Thereafter, the exhaust gas is purified by an oxidation catalyst 25, the collection device 26, and a SCR catalyst 27 which are arranged from the downstream side of the turbine 24 in order, and is released to an atmosphere. In addition, a portion of the exhaust gas is cooled by an EGR cooler 29 provided in an EGR passage 28, and is supplied to the intake pipe 16 by an EGR valve 30 to be mixed with the intake air.

During the operation of the engine 10, the fuel injection valve 14, the intake throttle 20, the EGR valve 30, and an urea water injection valve 35 are controlled by a controller 34 with which a plurality of sensors including an NOx sensor 31, a differential pressure sensor 32, and the PM sensor 33 are connected.

Examples of controls of the controller 34 may include a reduction control which adjusts an injection amount of urea water injected from the urea water injection valve 35 according to a detection value of the NOx sensor 31, that is, an NOx content in the exhaust gas, and a regeneration control which adjusts an injection amount and an inject timing of fuel post-injected from the fuel injection valve 14 according to the deposition amount of the PM based on a detection value of the differential pressure sensor 32, that is, a differential pressure between before and after the collection, device 26.

Further, during the operation of the engine 10, in a case where the detection value of the PM sensor 33 arranged at the downstream of the collection device 26, that is, a PM content $q_{DOWN_PM}$ in the exhaust gas at the downstream side of the collection device 26 is equal to or more than a regulation value, the collection device 26 has an abnormality, and therby, a diagnosis device 36 embedded in the controller 34 performs a control to turn on or flicker a warning lamp (M.I.L.) 37 and warns an operator of the abnormality.

A factor which causes the PM content $q_{DOWN_PM}$ in the exhaust gas at the downstream side of the collection device 26 to be equal to or more than the regulation value is a breakage such that the collection device is partially bored by being eroded by the regeneration control, for example. Then, in order to early detect the breakage of the collection device 26 before the PM content $q_{DOWN_PM}$ in the exhaust gas released into the air has the regulation value or more, it is necessary to estimate PM content $q_{UP_PM}$ in the exhaust gas at the upstream side of the collection device 26 with a high degree of accuracy.

In this regard, the engine 10 of the present invention includes an estimating device 40 which estimates the PM content $q_{UP_PM}$ in the exhaust gas at the upstream side of the collection device 26 from the detection value (NOx content) $q_{UP_Nox}$ of the NOx sensor 31, on based on that an NOx emission amount $q_{OUT_NOx}$ and a PM emission amount $q_{OUT_PM}$ from the cylinder 13 has a trade-off relation.

The NOx sensor 31 is a sensor which is arranged in a position where an NOx content $q_{UP_NOx}$ in the exhaust gas at the upstream side of the collection device 26 can be detected, that is, in the exhaust pipe 23 on the upstream side of the exhaust manifold 22 or the collection device 26.

In consideration of the fact that the NOx sensor 31 uses the trade-off relation between the NOx emission amount $q_{OUT_NOx}$ and the PM emission amount $q_{OUT_PM}$ from the cylinder 13, the NOx sensor 31 is desirably arranged in the exhaust manifold 22 which umbers exhaust gas emitted from a plurality of cylinders 13 to guide the exhaust gas to the exhaust pipe 23, or the exhaust pipe 23 in the vicinity of the exhaust manifold 22. When the NOx sensor 31 is arranged in the vicinity of the cylinder 13, the NOx sensor 31 can detect substantially the same value as the NOx emission amount $q_{OUT_NOx}$ improving the accuracy of estimating the PM content $q_{UP_PM}$.

The NOx sensor 31 is configured of a solid electrolyte having oxygen ion conductivity such as zirconia ($ZrO_2$), and detects the NOx content $q_{UP_NOx}$ in the exhaust gas by detecting an amount of the oxygen which is generated when reduction or decomposition is performed from NOx in the exhaust gas therein. Since the interior of the NOx sensor 31 is configured such that the large PM of particles does not penetrate thereinto, although the NOx sensor 31 is exposed to the exhaust gas before the PM is collected by the collection device 26, there is a less possibility that the PM is deposited therein so that the NOx content $q_{UP_NOx}$ cannot be detected, or the fault occurs due to the deposited PM. Accordingly, although the NOx sensor 31 is arranged at the upstream of the collection device 26, the NOx content $q_{UP_NOx}$ can be detected stably, The estimating device 40 is a program embedded in the controller 34, and allows the controller 34 to execute a process to estimate the PM content $q_{UP_PM}$ when the detection value of the NOx sensor 31 is input. Incidentally, in the embodiment, in the program, the estimating device 40 is embedded in the controller 34. However, the estimating device 4(1 may be configured as a device which includes a central processing unit or a storage medium storing the same program and is separate from the controller 34.

The trade-off relation between the NOx emission amount $q_{OUT_NOx}$ and the PM emission amount $q_{OUT_PM}$ means a relation such that when the NOx emission amount $q_{OUT_PM}$ increases, the PM emission amount $q_{OUT_PM}$ decreases, and on the other hand, when the NOx emission amount $q_{OUT_NOx}$ decreases, the PM emission amount $q_{OUT_PM}$ increases.

Specifically, when the intake air taken in the cylinder 13 and the fuel injected from the fuel injection valve 14 are mixed and combusted to be exhaust gas, in a case where the combustion temperature is a high temperature, in a case where the combustion period continues long, or in a case where a ratio of the fuel injection amount with respect to the intake amount of the intake air is small, the injected fuel is completely combusted in the, cylinder 13, so that the PM emission amount $q_{OUT_PM}$ decreases, and a reaction of the nitrogen and the oxygen is promoted after the fuel is combusted completely, so that the NOx emission amount $q_{OUT_NOx}$ in the exhaust gas increases.

On the other hand, in a case where the combustion temperature is low, in a case where the combustion period is short, or in a case where the ratio of the fuel injection amount with respect to the intake amount of the intake air is large, the injected fuel cannot be completely combusted the cylinder 13, so that the PM emission amount $q_{OUT_PM}$ increases, and the reaction of the nitrogen and the oxygen are not promoted so that the NOx emission amount $q_{OUT_NOx}$ decreases.

Figure 2:
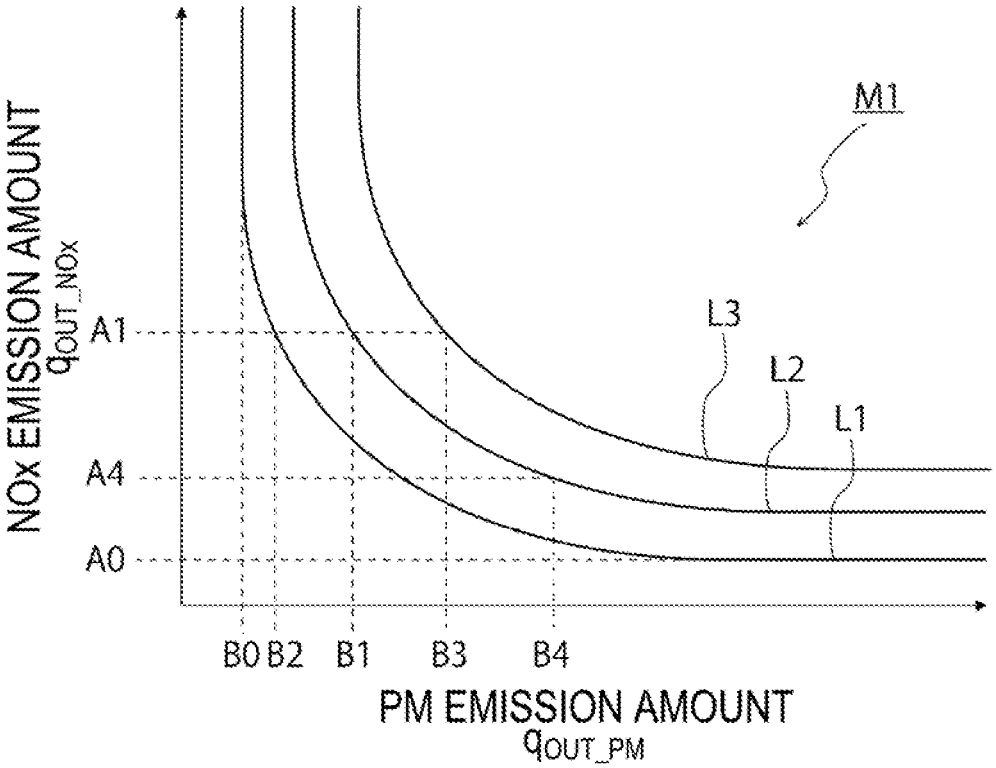
FIG. 2 is a map exemplarily illustrating a trade-off map of FIG. 1.

As described above, the NOx emission amount $q_{OUT_NOx}$ and the PM emission amount $q_{OUT_PM}$ in the exhaust gas emitted from the cylinder 13 through the exhaust valve 15 has a trade-off relation, in the estimating device 40 of the embodiment, the trade-off relation can be used with reference to a trade-off map M1 illustrated in FIG. 2.

FIG. 2 illustrates one example of the trade-off map M1. The trade-off map M1 is map data which is obtained in advance by experiments or tests, and is stored in a storage medium of the controller 34. Incidentally, in a case where the estimating device 40 is configured to be separated from the controller 34, the trade-off map M1 may be stored in a storage medium of the estimating device 40.

In the trade-off map M1, a plurality of trade-off lines Lx (L1 to L3) are set according to an operating condition of the engine 10. Each of the lines indicates a relation between the NOx emission amount $q_{OUT_NOx}$ and the PM emission amount $q_{OUT_PM}$ according to the operating condition.

Incidentally, the operating condition of the engine 10 is exemplified by the state of being determined from an output map based on an output torque and an engine speed of the engine 10 used when the controller 34 performs an injection amount control to adjust the fuel injection amount by the fuel injection valve 14. Herein, with the trade-off line L2 as a reference, the operating condition which has a low output compared to the state of the trade-off line L2 is set as the trade-off line L1, and the operating condition having a high output is set as the trade-off line L3. As illustrated in FIG. 2, in the trade-off map M1 of the embodiment, only three lines are set. However, actually, a plurality of trade-off lines are set according to the operating condition. In addition, the operating condition of the engine 10 may be determined in consideration of an intake air amount control, an EGR circulation control, or the like.

When the trade-off line L2 is described as an example, in each of the NOx emission amount $q_{OUT_NOx}$ and the PM emission amount $q_{OUT_PM}$, minimum values A0 and B0 are set, and the relation between the NOx emission amount $q_{OUT_NOx}$ and the PM emission amount $q_{OUT_PM}$ rpm has a substantially inverse-proportional relation in a case where one thereof is not the minimum values A0 and B0. For example, when the NOx emission amount $q_{OUT_NOx}$ in the trade-off line L2 is A1, the PM emission amount $q_{OUT_PM}$ becomes B1 based on a substantially inverse-proportional curve.

In the trade-off map M1, even in a case where the NOx emission amount $q_{OUT_NOx}$ is the same A1, if the operating condition of the engine 10 is different, the PM emission amount $q_{OUT_PM}$ is different from B1, B2, and B3. In addition, in a case where the operating condition of the engine 10 is not changed, the NOx emission amount $q_{OUT_NOx}$ decreases from A1 to A4, and the PM emission amount $q_{OUT_PM}$ increases from B1 to B4 by inverse time the difference ΔA between A1 and A4.

Figure 3:
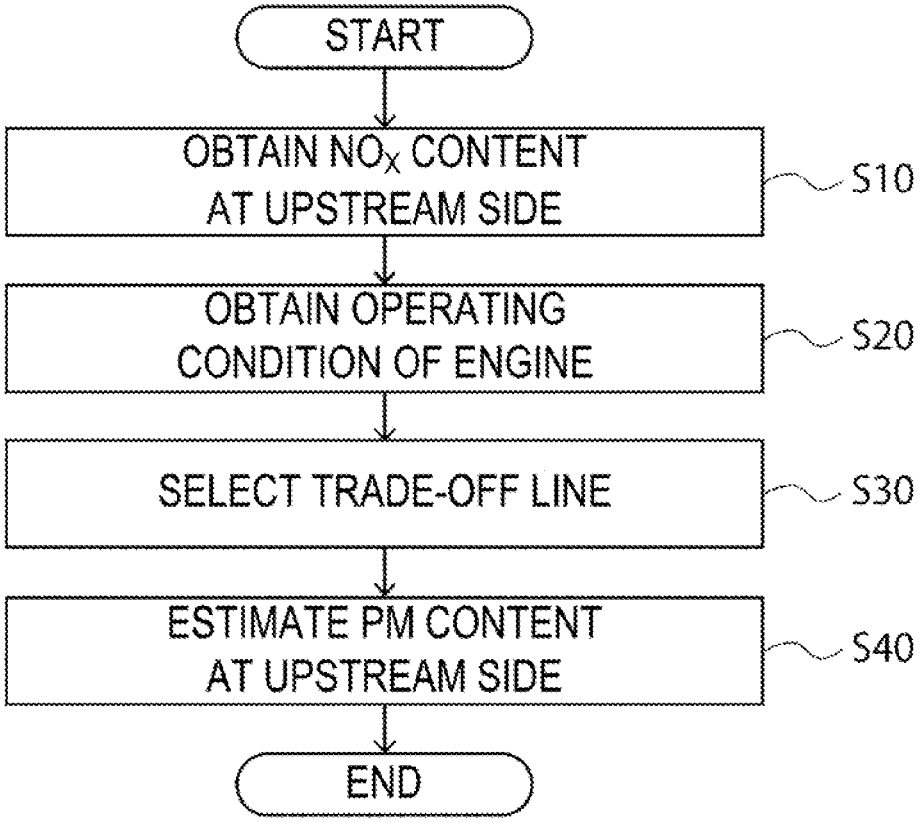
FIG. 3 is a flowchart exemplarily illustrating a first embodiment of an exhaust-gas-component estimating method of the present invention.
Figure 4:
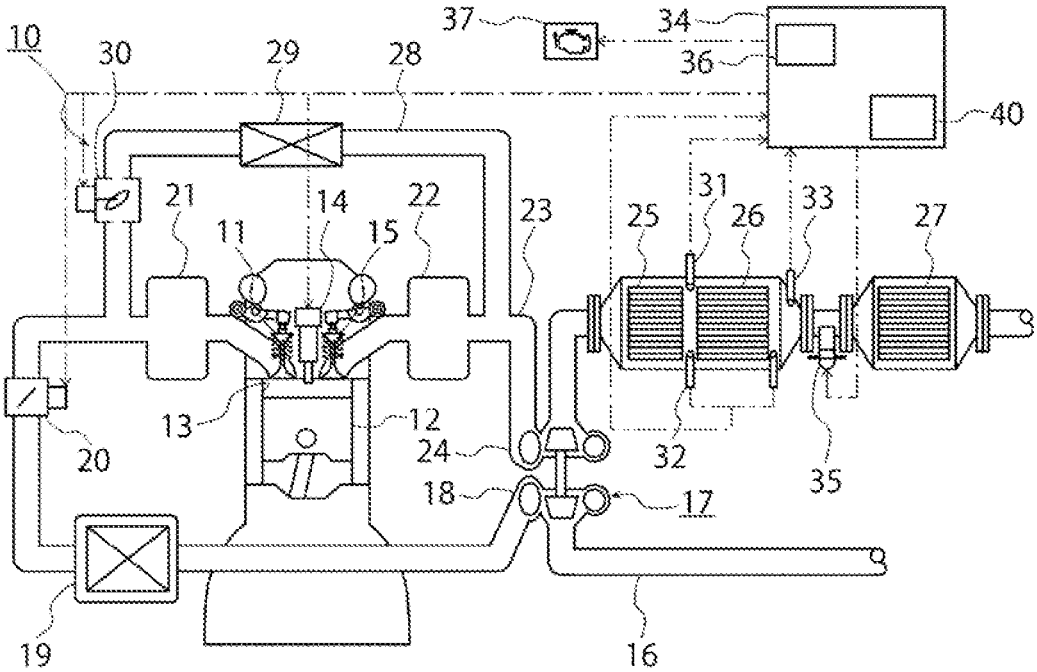
FIG. 4 is an explanation view exemplarily illustrating a second embodiment of the internal combustion engine of the present invention.

Next, the exhaust-gas-component estimating method in the estimating device 40 of the first embodiment will be described with reference to a flowchart of FIG. 3. The estimating method of the component amount is a method which estimates the PM content $q_{UP_PM}$ in the exhaust gas at the downstream side of the collection device 26 using the detection value (NOx content) $q_{UP_NOx}$ of the NOx sensor 31, and the trade-off relation between the NOx emission amount $q_{OUT_NOx}$ and the PM emission amount $q_{OUT_PM}$.

First, in step S10, the estimating device 40 obtains the NOx content $q_{UP_NOx}$ in the exhaust gas at the upstream side of the collection device 26 using the NOx sensor 31. Next, in step S20, the estimating device 40 obtains the operating condition of the engine 10 from the controller 34. In step S20, the operating condition of the engine 10 based on an injection amount control, an intake air amount control, an EGR circulation control, and the like of the controller 34 is obtained. Incidentally, step 810 and step 820 may be in random order.

Next, in step 830 the estimating device 40 selects the trade-off lines Lx corresponding to the operating conditions of the engine 10 with reference to the trade-off map M1. Next, in step S40, the estimating device 40 considers the NOx content $q_{UP_NOx}$ obtained in step S10 as the NOx emission amount $q_{OUT_NOx}$ in the selected trade-off lines Lx, calculates the PM emission amount $q_{OUT_PM}$ in the trade-off lines Lx, and estimates the PM emission amount $q_{OUT_PM}$ as the PM content $q_{UP_PM}$ in the exhaust gas at the upstream side of the collection device 26. Then, this method is completed.

For example, the trade-off lines Lx selected from the operating condition of the engine 10 is set as the trade-off line L2, the detection value of the NOx sensor 31 is set as A1, and the PM content $q_{UP_PM}$ in the exhaust gas at the upstream side of the collection device 26 estimated by the above-described estimating method is set as B1.

According to the engine 10 and the exhaust-gas-component estimating method, the PM content $q_{UP_PM}$ in the exhaust gas at the upstream side of the collection device 26 can be accurately estimated with a simple configuration which uses the NOx sensor 31 which is mounted in the engine of the conventional configuration and detects the NOx content $q_{UP_NOx}$ in the exhaust gas, and the trade-off relation between the NOx emission amount $q_{OUT_NOx}$ and the PM emission amount $q_{OUT_PM}$.

As in the embodiment, the estimating device 40 can estimate the PM content $q_{UP_PM}$ according to the operating condition of the engine 10 by estimating the PM content $q_{UP_PM}$ on the upstream side of the collection device 26 with reference to the trade-off map M1 in which the NOx emission amount $q_{OUT_NOx}$ and the PM emission amount $q_{OUT_PM}$ are set in advance in each of the operating conditions of the engine 10, which is advantageous in improving the accuracy. Additionally, the PM content $q_{UP_PM}$ can be estimated with a simple configuration which refers only to the detection value (NOx content) $q_{UP_NOx}$ of the NOx sensor 31 and the trade-off map M1, which is advantageous in simplifying the estimating process.

Figure 5:
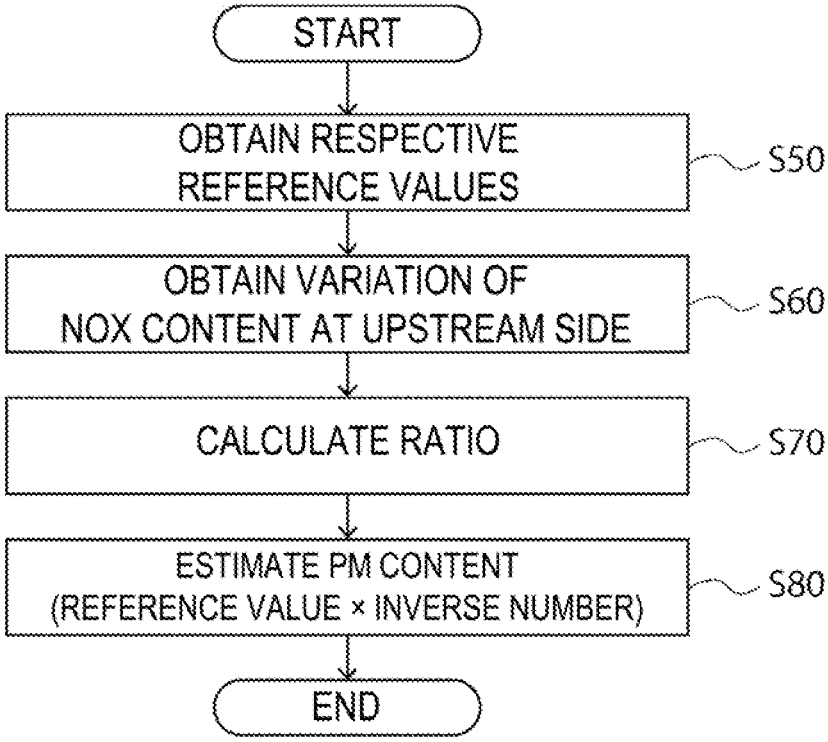
FIG. 5 is a flowchart exemplarily illustrating a second embodiment of the estimating method of the component amounts of the exhaust gas of the present invention.

FIG. 5 exemplarily illustrates a configuration of a second embodiment of the engine 10 of the present invention. The estimating device 40 of the engine 10 does not use the trade-off map M1 of the first embodiment, and is configured to estimate a variation of the PM content $q_{UP_PM}$ in the exhaust gas at the upstream side of the collection device 26 by multiplying the PM emission amount $q_{OUT_PM}$ calculated from the operating condition of the engine 10 and an inverse number 1/n of the ratio n of the change of the detection value (NOx content) $q_{UP_NOx}$ of the NOx sensor 31.

In the embodiment, the NOx sensor 31 is arranged in the exhaust pipe 23 in the vicinity of the collection device 26. The vicinity of the collection device 26 is, the downstream side of the oxidation catalyst 25. NO (nitrogen monoxide) is oxidized by the oxidation catalyst 25 to generate NO2 (nitrogen dioxide), but the NOx content $q_{UP_NOx}$ is rarely changed. As a result, the detection value (NOx content) $q_{UP_NOx}$ of the NOx sensor 31 arranged in the vicinity of the collection device 26 is considered as the NOx emission amount $q_{OUT_NOx}$.

The trade-off relation between the NOx emission amount $q_{OUT_NOx}$ and the PM emission amount $q_{OUT_PM}$ indicates an inverse-proportional relation between the NOx emission amount $q_{OUT_NOx}$ and the PM emission amount $q_{OUT_PM}$, that is, a relation such that the PM emission amount $q_{OUT_PM}$ becomes the inverse number 1/n of the ratio n when the NOx emission amount $q_{OUT_NOx}$ is the ratio n. Incidentally, the ratio n is a rational number.

Figure 6:
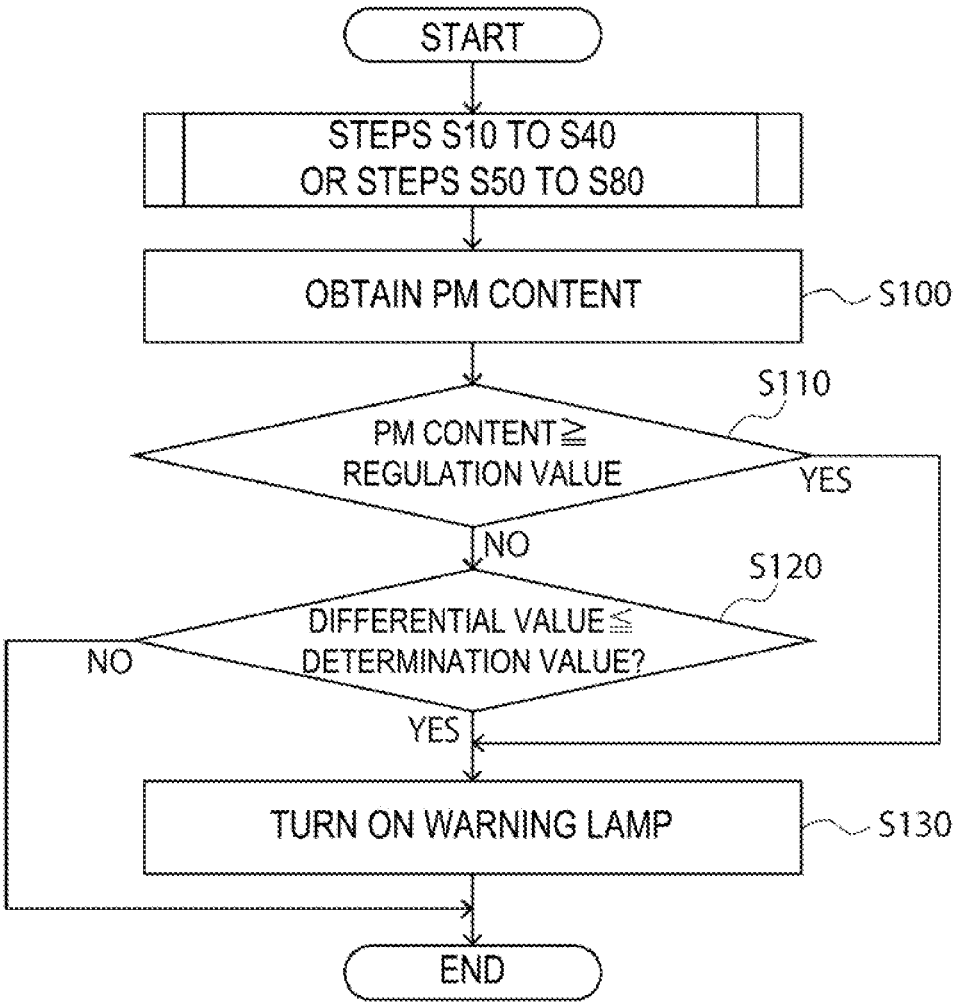
FIG. 6 is a flowchart exemplarily illustrating a method of diagnosing a breakage of a collection device illustrated in FIGS. 1 and 4.

Next, the exhaust-gas-component estimating method in the estimating device 40 of the second embodiment will be described with reference to the flowchart of FIG. 6.

First, in step S50, the estimating device 40 obtains, from the controller 34, each reference value of the NOx emission amount $q_{OUT_NOx}$ and the PM emission amount $q_{OUT_PM}$ based on the operating condition of the engine 10. In step S50, each reference value obtained in advance by experiments or tests is obtained from the operating condition of the engine 10 based on the injection amount control, the intake air amount control, the EGR circulation control, and the like of the controller 34.

Next, in step S60, the estimating device 40 obtains a variation $\Delta q_{UP_NOx}$ of the NOx content $q_{UP_NOx}$ in the exhaust gas at the upstream side of the collection device 26 using the NOx sensor 31. The variation $\Delta q_{UP_NOx}$ in step S60 is a variation per a predetermined time or a variation in each of the operating conditions of the engine 10.

Next, in step S70, the estimating device 40 calculates the ratio n of the change of the NOx content $q_{UP_NOx}$ from the reference value of the NOx emission amount $q_{OUT_NOx}$ obtained in step S50 and the variation $\Delta q_{UP_NOx}$ obtained in step S60.

Next, in step S80, by multiplying the reference value of the PM emission amount $q_{OUT_PM}$ obtained in step S50 by the inverse number 1/n of the ratio n calculated in step S70, the estimating device 40 estimate the PM emission amount $q_{OUT_PM}$ as the PM content $q_{UP_PM}$ in the exhaust gas at the upstream side of the collection device 26. Then, this method is completed.

Incidentally, step S50 is performed at the time of starting up the engine 10. The PM content $q_{UP_PM}$ is estimated with the PM emission amount $q_{OUT_PM}$ at the time of starting up set as a reference value by performing steps S60 to step S80 after a predetermined time or after the change of the operating condition of the engine 10. Next, the PM content $q_{UP_PM}$ at next time may be estimated with the estimated PM content $q_{UP_PM}$ set as a reference value by performing steps S60 to S80 again. As described above, the PM content $q_{UP_PM}$ may be estimated by performing steps S50 to S80 repeatedly.

According the engine 10 of the second embodiment and the estimating method, similarly to the first embodiment, the PM content $q_{UP_PM}$ in the exhaust gas at the upstream side of the collection device 26 can be accurately estimated with a simple configuration. Additionally, using the change of the NOx content $q_{UP_NOx}$ and the trade-off relation between the NOx emission amount $q_{OUT_NOx}$ and the PM emission amount $q_{OUT_PM}$, the PM content $q_{OUT_PM}$ can be estimated with a high degree of accuracy even without reference to the map data.

Next, as a control to use the PM content $q_{UP_PM}$ on the upstream side of the collection device 26 estimated by the above-described estimating method can be exemplified by the diagnosis of the breakage of the collection device 26 or the regeneration control. Herein, as an example, a method of diagnosing the breakage of the collection device 26 will be described with reference to the flowchart illustrated in FIG. 6. Incidentally, the diagnosing method is a method which is performed whenever the operating time of the engine 10 passes a time set in advance, that is, a driving cycle is counted.

In step S100 after the above-described steps S10 to S40 or steps S50 to S80 are performed in order, the diagnosis device 36 obtains the PM content $q_{DOWN_PM}$, which is detected by the PM sensor 33 arranged at the downstream of the collection device 26, in the exhaust gas having passed through the collection device 26.

Next, in step S110, the diagnosis device 36 determines whether the PM content $q_{DOWN_PM}$ in the exhaust gas at the downstream side of the collection device 26 is a regulation value qa or more. The regulation value qa is a value which is set according; to a law of Japan, Europe, United States of America, and the like. In step S110, in a case where the PM content $q_{DOWN_PM}$ is the regulation value qa or more, the procedure proceeds to step S130. On the other hand, in step S110, in a case where the PM content $q_{DOWN_PM}$ is less than the regulation value qa, the procedure proceeds to step S120.

Next, in step S120, the diagnosis device 36 determines whether a differential value Δq between the estimated PM content $q_{UP_PM}$ and the PM content $q_{DOWN_PM}$ obtained using the PM sensor 33 is less than a determination value Δqa set in advance.

The determination value Δqa is set in advance by the experiments or the tests to such a value that can determine a state where the collection device 26 is broken, specifically, a state where the collection device 26 is partially bored by being eroded by the regeneration control.

For example, since, in a state where the collection device 26 is not broken, the amount of the PM which is collected when the exhaust gas passes through the collection device 26 is substantially constant, the differential value Δq between the PM content $q_{UP_PM}$ the upstream side and the PM content $q_{DOWN_PM}$ on the downstream side becomes substantially constant value. On the other hand, in a state where the collection device 26 is broken, when the exhaust gas passes through the collection device 26, a lot of PM is released from the broken place to the downstream side of the collection device 26. Thus, the differential value Δq between the PM content $q_{UP_PM}$ of the upstream side and the PM content $q_{DOWN_PM}$ of the downstream side becomes a value less than a value in an unbroken state.

Accordingly, in a state where the collection device 26 is not broken, the determination value Δqa is preferably set as the same value as the substantially constant differential value Δq between the PM content $q_{UP_PM}$ on the upstream side and the PM content $q_{DOWN_PM}$ on the>downstream side.

In step S120, a case where the differential value Δq between the PM content $q_{UP_PM}$ on the upstream side and the PM content $q_{DOWN_PM}$ on the downstream side is the determination value Δqa or more indicates that the collection device 26 is in an unbroken state. Thus, this diagnosing method is completed. On the other hand, in step S120, in a case where the differential value Δq between the PM content $q_{UP_PM}$ on the upstream side and the PM content $q_{DOWN_PM}$ on the downstream side is less than the determination value Δqa, the procedure proceeds to step S130.

Next, in step S130, the diagnosis device 36 warns the operator of the breakage of the collection device 26 by turning on the warning lamp 37. Then, this diagnosing method is completed.

According to the diagnosing method, with the simple configuration which uses the trade-off relation with the detection value (NOx content) $q_{UP_NOx}$ of the NOx sensor 31, the breakage of the collection device 26 can be accurately diagnosed from the differential value Δq of the PM content $q_{UP_PM}$ and $q_{DOWN_PM}$ before and after the collection device 26 using the PM content $q_{UP_PM}$, which is estimated accurately, in the exhaust gas at the upstream side of the, collection device 26. In this, manner, even in a case the PM content $q_{DOWN_PM}$ in the exhaust gas at the downstream side of the collection device 26 is less than the regulation value qa, the operator can be warned early in a case where the breakage occurs in the collection device 26. Thus, it can be avoided in advance that the PM which is equal to or more than the regulation value qa in the atmosphere is released.

Incidentally, an example where the breakage of the collection device 26 is determined based on the differential value Δq between the PM content $q_{UP_PM}$ and the PM content $q_{DOWN_PM}$ is described in the above-described step S120. However, step S120 is not limited to the determination. For example, a determination may be performed which uses the map in which the PM content $q_{DOWN_PM}$ corresponding to the PM content $q_{UP_PM}$ is set in advance, or a value obtained by correcting the PM content $q_{DOWN_PM}$ based on the PM content $q_{UP_PM}$.

In the regeneration control of the collection device 26 which uses the PM content $q_{UP_PM}$, which is estimated by the above-described estimating method, on the upstream side of the collection device 26, the regeneration control in which the PM content $q_{UP_PM}$ flowing in the collection device 26 is considered can be performed using the PM content $q_{UP_PM}$ on the upstream side of the collection device 26 in addition to the differential pressure detected by the differential pressure sensor 32. Thus, the regeneration control of the collection device 26 is performed at a more proper timing. In this manner, the unnecessary regeneration control is avoided so that a fuel consumption can be improved, or the breakage of the collection device 26 due to the regeneration control can be suppressed.

Incidentally, using the trade-off map M1 of the first embodiment and the change of the NOx content $q_{UP_NOx}$ in the second embodiment, the PM content $q_{UP_PM}$ on the upstream side of the collection device 26 can be estimated with a higher degree of accuracy, which is advantageous in improving the accuracy.

REFERENCE SIGNS LIST

10 engine
13 cylinder
22 exhaust manifold
23 exhaust pipe
26 collection device
31 NOx sensor
33 PM sensor
34 controller
40 estimating device
$q_{UP_NOx}$ content
$q_{UP_PM}$ content
$q_{OUT_Nox}$ emission amount
$q_{OUT_PM}$ emission amount

The invention claimed is:

1. An internal combustion engine, which includes a PM collector that is arranged in an exhaust pipe through which an exhaust gas emitted from a cylinder passes and collects PM contained in the exhaust gas and an NOx sensor that is arranged on an upstream side of the PM collector and detects an NOx content in the exhaust gas, comprising:

a PM sensor which is arranged at a downstream side of the PM collector of the exhaust pipe and detects the PM content in the exhaust gas at the downstream side of the PM collector;

wherein the internal combustion engine is provided with a controller that:

estimates a PM content in the exhaust gas at the upstream side of the PM collector from a detection value of the NOx sensor, based on a trade-off relation between an NOx emission amount and a PM emission amount from the cylinder, calculates a differential value between the estimated PM content and the PM content detected by the PM sensor, and diagnoses, in a case where the calculated differential value is less than a determination value set in advance, that the PM collector is in an abnormal state.

2. The internal combustion engine according to claim 1, wherein the controller is configured to estimate the PM content in the exhaust gas at the upstream side of the PM collector, with reference to a detection value of the NOx sensor and a trade-off map in which the NOx emission amount and the PM emission amount are set in advance in each of operating conditions of the internal combustion engine.

3. The internal combustion engine according to claim 1, wherein the controller is configured to estimate a variation of the PM content in the exhaust gas at the upstream side of the PM collector by multiplying the PM emission amount calculated based on the operating condition of the internal combustion engine and an inverse number of a ratio of change of a detection value of the NOx sensor.

4. The internal combustion engine according to claim 1, wherein the NOx sensor is arranged in an exhaust manifold which gathers the exhaust gas emitted from a plurality of the cylinders to guide the exhaust gas to the exhaust pipe, or the exhaust pipe in a vicinity of the exhaust manifold.

5. An exhaust-gas-component estimating method which estimates a PM content in an exhaust gas at an upstream side of a PM collector which is arranged in an exhaust pipe, through which the exhaust gas emitted from a cylinder of an internal combustion engine passes, and collects the PM contained in the exhaust gas, the method comprising:

detecting the PM content in the exhaust gas by a PM sensor, which is arranged downstream of the PM collector of the exhaust pipe;

detecting an NOx content in the exhaust gas at the upstream side of the PM collector using an NOx sensor arranged on the upstream side of the PM collector;

estimating the PM content in the exhaust gas at the upstream side of the PM collector from the detected NOx content, based on an NOx emission amount from the cylinder and a trade-off relation with a PM emission amount;

calculating a differential value between the estimated PM content and the PM content detected by the PM sensor, and diagnosing, in a case where the calculated differential value is less than a determination value set in advance, that the PM collector is in an abnormal state.

* * * * *